US008098865B2

(12) United States Patent
Ho et al.

(10) Patent No.: US 8,098,865 B2
(45) Date of Patent: Jan. 17, 2012

(54) BEHIND-THE-EAR HEARING DEVICE WITH A MAGNETICALLY-ATTACHED EAR HOOK

(75) Inventors: Wai Kit David Ho, Singapore (SG); Wee Haw Koo, Singapore (SG); Beng Hai Tan, Singapore (SG)

(73) Assignee: Siemens Audiologische Technik GmbH, Erlangen (DE)

( * ) Notice: Subject to any disclaimer, the term of this patent is extended or adjusted under 35 U.S.C. 154(b) by 979 days.

(21) Appl. No.: 12/070,887

(22) Filed: Feb. 21, 2008

(65) Prior Publication Data

US 2008/0205680 A1 Aug. 28, 2008

(30) Foreign Application Priority Data

Feb. 22, 2007 (DE) ..... 10 2007 008 737

(51) Int. Cl.
*H04R 25/00* (2006.01)

(52) U.S. Cl. ..... 381/330

(58) Field of Classification Search ..... 381/330
See application file for complete search history.

(56) References Cited

U.S. PATENT DOCUMENTS

| | | | | |
|---|---|---|---|---|
| 5,645,074 | A * | 7/1997 | Shennib et al. | 600/559 |
| 6,438,245 | B1 * | 8/2002 | Taenzer et al. | 381/330 |
| 2002/0131614 | A1 * | 9/2002 | Jakob et al. | 381/314 |
| 2004/0044389 | A1 | 3/2004 | Crawford | |
| 2006/0266947 | A1 | 11/2006 | Krieg | |
| 2008/0199031 | A1 * | 8/2008 | Ho et al. | 381/322 |

FOREIGN PATENT DOCUMENTS

| | | | |
|---|---|---|---|
| DE | 1909658 | U | 2/1965 |
| DE | 4327634 | C1 | 6/1994 |
| DE | 10023907 | A1 | 11/2001 |
| DE | 20114121 | U1 | 3/2003 |
| WO | WO 97/04619 | A1 | 2/1997 |
| WO | 2004004416 | A1 | 1/2004 |

OTHER PUBLICATIONS

Communication/Search Report from European Patent Office, Oct. 13, 1998, pp. 1-6.

* cited by examiner

*Primary Examiner* — Jeffrey Donels
*Assistant Examiner* — Andrew R Millikin

(57) ABSTRACT

An ear hook is to be able to be tightly attached to a hearing device housing in a simple fashion. To this end, provision is made for it to be possible to clip the ear hook onto the hearing device housing. One of the two parts; hearing device housing and ear hook has a sound outlet tube, which can be inserted into a corresponding opening in the other part. The two parts are detachably fastened to one another in an axial direction in respect of the sound outlet tube by means of a magnetic connection. The magnetic connection ensures that the two components are fitted tightly onto one another, though it enables said two components to rotate in respect of each other.

8 Claims, 1 Drawing Sheet

BEHIND-THE-EAR HEARING DEVICE WITH A MAGNETICALLY-ATTACHED EAR HOOK

CROSS REFERENCE TO RELATED APPLICATIONS

This application claims priority of German application No. 10 2007 008 737.5 filed Feb. 22, 2007, which is incorporated by reference herein in its entirety.

FIELD OF THE INVENTION

The present invention relates to a behind-the-ear hearing device with a hearing device housing and an ear hook, which can be clipped onto the hearing device housing and which is used to attach the behind-the-ear hearing device to an ear of a hearing device wearer.

BACKGROUND OF THE INVENTION

Hearing devices are portable hearing apparatuses which are used to supply the needs of the hard-of-hearing. To accommodate the numerous individual requirements, different configurations of hearing devices such as behind-the-ear hearing devices (BTE), in-the-ear hearing devices (ITE), e.g. including conch hearing devices or channel hearing devices (CIC), are provided. The hearing devices designed by way of example are worn on the outer ear or in the auditory canal. Furthermore, bone conduction hearing aids, implantable or vibrotactile hearing aids are also available on the market. The damaged hearing is herewith either stimulated mechanically or electrically.

Essential components of the hearing devices include in principal an input converter, an amplifier and an output converter. The input converter is generally a receiving transducer, e.g. a microphone and/or an electromagnetic receiver, e.g. an induction coil. The output converter is mostly realized as an electroacoustic converter, e.g. a miniature loudspeaker, or as an electromechanical converter, e.g. a bone conduction receiver. The amplifier is usually integrated into a signal processing unit. This basic configuration is shown in the example in FIG. 1 of a behind-the-ear hearing device. One or a number of microphones 2 for recording the ambient sound are incorporated in a hearing device housing 1 to be worn behind the ear. A signal processing unit 3, which is similarly integrated into the hearing device housing 1, processes the microphone signals and amplifies them. The output signal of the signal processing unit 3 is transmitted to a loudspeaker and/or receiver 4, which outputs an acoustic signal. The sound is optionally transmitted to the ear drum of the device wearer via a sound tube, which is fixed with an otoplastic in the auditory canal. The power supply of the hearing device and in particular of the signal processing unit 3 is provided by a battery 5 which is likewise integrated into the hearing device housing 1.

Ear hooks are attached to hearing device housings in different manners. So-called snap-fit ear hooks exists on the one hand. They can be clipped onto the hearing device housing and snapped in place. As a result of the mechanical tolerances, a connection of this type does not ensure firm positioning and is thus generally only used with lower priced hearing devices. Furthermore, this connection normally predetermines a fixed angular position of the ear hook in respect of the hearing device housing. It is not able to rotate about its longitudinal axis.

Connections for attaching ear hooks to hearing device housings are also known, with which the ear hook is screwed and unscrewed, or with which it is snapped on and unscrewed. To achieve an individual adjustment of the angle of the ear hook in the process, the user has to loosen or tighten the screw of the ear hook. This will however influence the functionality of the ear hook, since the connection between the ear hook and the hearing device housing is then not tightly sealed.

Usually a screwed ear hook cannot be re-used. The reason for this lies in the fact that the thread is immediately cut by means of a metallic connecting piece either of the hearing device housing or of the ear hook. That is to say the screw thread is only produced during the screwing and unscrewing process.

The publication DE 100 23 907 A1 discloses a hearing device with a battery. The hearing device has a housing, which surrounds the electrical components of the hearing device including the battery. A carrying hook is attached to the housing.

The publication WO 97/04619 also discloses a hearing device for wearing behind the ear. A carrying hook is there attached to the housing and/or sound outlet connection piece.

The publication DE 1 909 658 U also discloses a device for the hearing impaired to be worn behind the ear. The carrying hook is there likewise attached to a connecting piece in a rotatable fashion. A cover is also arranged over the carrying hook.

SUMMARY OF THE INVENTION

The object of the present invention is thus to attach the ear hook to a housing of a behind-the-ear hearing device in a simple and tightly sealed fashion.

In accordance with the invention, this object is achieved by a behind-the-ear hearing device with a hearing device housing and ear hook, which can be clipped onto the hearing device housing and which is used to attach the behind-the-ear hearing device to an ear of a hearing device wearer, with one of both parts; hearing device housing and ear hook, comprising a sound outlet tube, which can be inserted into a corresponding opening in the other part, and the two parts being detachably fastened to one another in an axial direction in respect of the sound outlet tube by means of a magnetic connection.

The magnetic connection advantageously allows the ear hook to sit very rigidly on the hearing device housing, so that the desired leak tightness can also be ensured. The attachment process is further possible by a simple clip-on process without screws.

The magnetic connection is preferably realized with an annular magnet which is arranged at the edge of the opening or around the sound outlet tube. The greatest magnetic force of the connection is thus encountered in precisely the area of the sound outlet tube, in which the tightest possible connection is desired at that time.

A ferromagnetic section of the part of the two parts not carrying the magnetic ring can be used as a magnetic counterpiece for the magnetic connection. Two expensive ring magnets thus need not be used. In addition, a ferromagnetic part does not attract dirt particles, which is however the case with a magnet.

According to a particularly preferred embodiment, the two parts; hearing device housing and ear hook can also be rotated about the axis of the sound outlet tube in respect of each other when attached to one another. The fastening angle of the ear hook can thus be individually adjusted to the hearing device housing.

A gap advantageously no longer exists between the two parts; hearing device housing and ear hook, when joined to one another. This not only ensures an acoustically tight transition from the hearing device housing to the ear hook, but can also prevent dirt from entering between the two parts.

A catch can also be arranged on one of the two parts and a recess on the other part, which, when the two parts are joined to one another, engage with each other. A rotationally fixed coupling of the ear hook to the hearing device housing can thus be achieved.

BRIEF DESCRIPTION OF THE DRAWINGS

The present invention is described in more detail with reference to the appended drawings, in which.

DETAILED DESCRIPTION OF THE INVENTION

The embodiments illustrated in more detail below represent preferred exemplary embodiments of the present invention.

Figure 1:
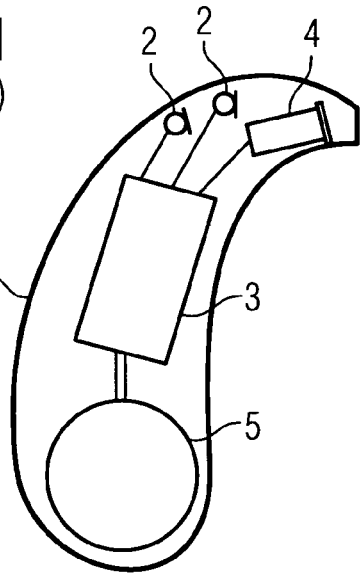
FIG 1 (Prior art)
FIG. 1 shows the basic design of a hearing device according to the prior art.

A hearing device housing 10 with a sound outlet tube connecting piece 11 is provided in accordance with the example in FIG. 1. This connecting piece is embodied purely in the manner of a tube and does not have any thread.

Figure 2:
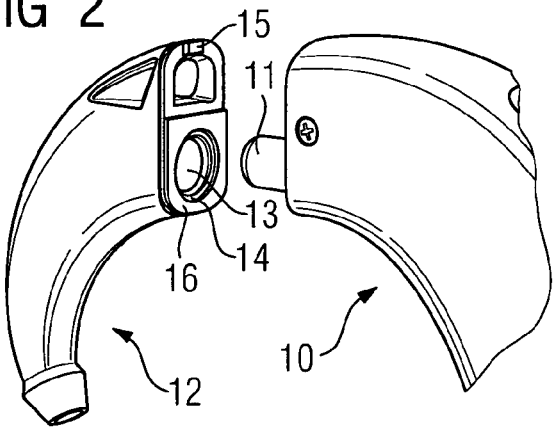
FIG. 2 shows an inventive ear hook and a hearing device housing in a disassembled state.

FIG. 2 also shows an ear hook 12, which is to be attached to the hearing device housing 10. The ear hook 12 has a sound opening 13 on its front side 16, which is to rest against the hearing device housing 10, into which sound opening 13 the sound outlet tube connecting piece 11 is to be inserted. A ring magnet 14 is arranged around this sound opening 13. It interacts with a magnetic or ferromagnetic ring, which is arranged around the sound outlet tube connecting piece 11, and is not visible in FIG. 2 (but is by contrast visible in FIG. 4). The ring magnet 14 causes the ear hook 12 to be drawn in the direction of the longitudinal axis of the sound outlet tube connecting piece 11 onto the hearing device housing 10 and to be fixed there.

In this exemplary embodiment, a clip 15 is also molded on the front side 16 of the ear hook 12, which also comprises the sound opening 13. It interacts mechanically with a correspondingly shaped recess on the contact surface (i.e. front side 17) of the hearing device housing 10. The dual mechanical meshing with the aid of the sound outlet tube connecting piece 11 and the clip 15 allow the ear hook 12 and the hearing device housing 10 to be joined in an anti-rotational manner.

Figure 3:
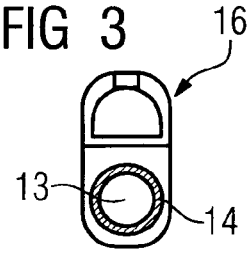
FIG. 3 shows a view of the front side of the ear hook in FIG. 2.

FIG. 3 shows a front view of the front side 16 of the ear hook 12, with which it is attached to the hearing device housing 10. The ring magnet 14 can be seen there, which surrounds the sound opening 13. A ferromagnetic ring can naturally also take the place of the ring magnet 14, provided a corresponding ring magnet is provided on the hearing device housing 10. FIG. 3 also shown the clip 15, which illustrates the anti-rotation mechanism which guards against a rotation about the axis of the circular sound opening 13.

Figure 4:
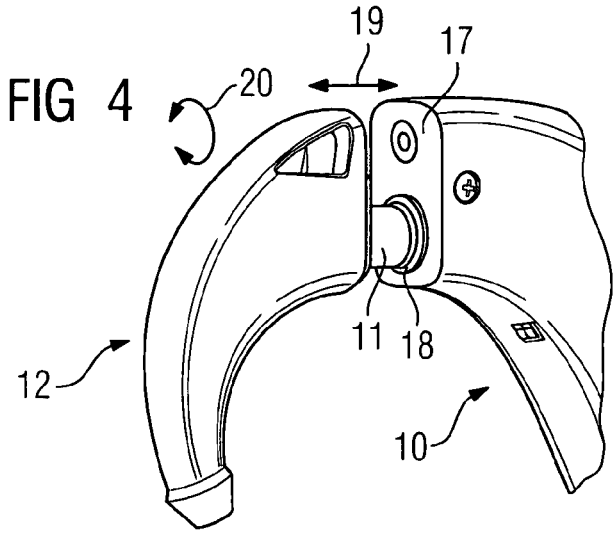
FIG. 4 shows the ear hook and the hearing device housing in FIG. 2 when being attached to one another.

FIG. 4 finally shows the two parts; the ear hook 12 and the hearing device housing 10 during the joining process. One perspective is selected, which shows the front side 17 of the hearing device housing 10, onto which the ear hook 12 is attached. The sound outlet tube connecting piece 11 can also be seen, which is surrounded by a ferromagnetic ring 18. If the ring 14 of the ear hook 12 is ferromagnetic, the ring 18 is naturally made of a magnetic material.

The joining of the two parts; hearing device housing 10 and ear hook 12 is carried out in the direction 19 as shown in FIG. 4. It runs parallel to the sound outlet tube connecting piece 11, which represents a mechanical guide element during the joining process.

According to the example in FIG. 4, the front side 17 has no recess and the front side 16 (not shown in FIG. 4) of the ear hook 12 has no clip 15. When attached, the ear hook 12 is thus able to rotate about the axis of the sound outlet tube connecting piece 11, opposite to the hearing device housing 10, in accordance with arrow 20. This allows an individual rotation angle to be set between the hearing device housing 10 and the ear hook 12, said angle accommodating the anatomical characteristics of a hearing device user.

When the ear hook 12 is completely joined to the hearing device housing 10, the two rings 14 and 18 rest directly against one another. In this process, a gap no longer exists between the two front sides 16 and 17. The connecting interface between the two components 10 and 12 is herewith acoustically tight and sealed against dirt. This mechanical interface thus results in hardly any acoustic losses, and neither is there the fear of dirt, which may interfere with the acoustic transfer, at this point.

Aside from the aforementioned advantages of safely and simply attaching the ear hook 12 to the hearing device housing 10 by means of the magnetic connection as well as the optional possibility of being able to rotate the ear hook in any manner despite a rigid connection, the magnetic plug-in connection is also advantageous in that it can in principle be released and reestablished as frequently as required, since the material is not cut into during the joining process. The individual components of the connection which engage with one another are thus not changed during the joining process. The user is thus able to remove and reattach the ear hook at any point, if he wears glasses intermittently for instance, onto which the hearing device housing can be attached or if he wishes to use longer or shorter ear hooks. Furthermore, this simple connection method can also be used for lower price hearing devices.

The invention claimed is:

1. A behind-the-ear hearing device, comprising:

a hearing device housing;

an ear hook that is clipped onto the hearing device housing; and a sound outlet tube arranged in the hearing device housing that is inserted into an opening in the ear hook, wherein the hearing device housing and the ear hook are configured to be detachably attached to one another in an axial direction of the sound outlet tube by a magnetic connection.

2. The behind-the-ear hearing device as claimed in claim 1, wherein the magnetic connection is generated by a ring-shaped magnet arranged at an edge of the opening in the ear hook and a ferromagnetic section of the hearing device housing as a magnetic counterpiece.

3. The behind-the-ear hearing device as claimed in claim 1, wherein the magnetic connection is generated by a ring-shaped magnet arranged around the sound outlet tube in the hearing device housing and a ferromagnetic section of the ear hook as a magnetic counterpiece.

4. The behind-the-ear hearing device as claimed in claim 1, wherein the hearing device housing and the ear hook are rotatable about the axis of the sound outlet tube in respect of one another when attached.

5. The behind-the-ear hearing device as claimed in claim 1, wherein the hearing device housing and the ear hook are directly attached to one another.

6. The behind-the-ear hearing device as claimed in claim 1, wherein a clip is arranged on the hearing device housing and a recess is arranged on the ear hook to engage the hearing device housing to the ear hook.

7. The behind-the-ear hearing device as claimed in claim 1, wherein a clip is arranged on the ear hook and a recess is arranged on the hearing device housing to engage the hearing device housing to the ear hook.

8. A behind-the-ear hearing device, comprising:

a hearing device housing;

an ear hook that is clipped onto the hearing device housing; and a sound outlet tube arranged in the ear hook that is inserted into an opening in the hearing device housing, wherein the hearing device housing and the ear hook are configured to be detachably attached to one another in an axial direction in respect of the sound outlet tube by a magnetic connection.

* * * * *